US005615945A

United States Patent [19]

Tseng

[11] Patent Number: 5,615,945

[45] Date of Patent: Apr. 1, 1997

[54] LIGHTING DEVICE FOR USE WITH COMPUTERS

[75] Inventor: Winger Tseng, Taipei, Taiwan

[73] Assignee: Noopro Industrial Corporation, Taipei, Taiwan

[21] Appl. No.: 624,747

[22] Filed: Mar. 27, 1996

[51] Int. Cl.[6] ..... H01R 33/00

[52] U.S. Cl. ..... 362/226; 362/253; 362/285; 362/413; 362/418

[58] Field of Search ..... 362/226, 285, 362/413, 414, 391, 418, 410, 419, 430, 253

[56] References Cited

U.S. PATENT DOCUMENTS 1,651,307 11/1927 Wilkinson ..... 362/226 X 5,034,865 7/1991 Sonneman ..... 362/410 X 5,091,834 2/1992 Kao et al. ..... 362/226

*Primary Examiner*—Stephen F. Husar

*Attorney, Agent, or Firm*—Bacon & Thomas

[57] ABSTRACT

A lighting device for use with a computer, including: an elongated, hollow, flexible neck, a plug fastened to the flexible neck at one end for connection to the computer, and a lamp assembly fastened to the flexible neck at an opposite end and connected to the plug by an electric wire, the flexible neck having a flexible metal wire axially mounted on the inside, the flexible metal wire having a hook at one end fixedly connected to the plug by a resin block, the resin block being molded on the hook of the flexible metal wire and one end of the electric wire and fixedly secured to the plug by a jacket to support the flexible neck and the lamp assembly, for permitting the flexible neck to be bent to the desired shape to move the lamp assembly to the desired position.

5 Claims, 4 Drawing Sheets

LIGHTING DEVICE FOR USE WITH COMPUTERS

BACKGROUND OF THE INVENTION

The present invention relates to lighting devices, and relates more particularly to such a lighting device for use with a computer which comprises an elongated, hollow, flexible neck, a plug fastened to the flexible neck at one end for connection to the computer, and a lamp assembly fastened to the flexible neck at an opposite end and connected to the plug by an electric wire, wherein the flexible neck has a flexible metal wire axially mounted ,on the inside, the flexible metal wire having a hook at one end fixedly connected to the plug by a resin block, the resin block being molded on the hook of the metal wire and one end of the electric wire and fixedly secured to the plug by a jacket to support the flexible neck and the lamp assembly, for permitting the flexible neck to be bent to the desired shape to move the lamp assembly to the desired position.

A variety of lighting fixtures such as pendent lamps, floor lamps, table and desk lamps, etc. may be used for room lighting. Desk lamps are commonly used with personal computers for illumination. A desk lamp, as shown in FIG. 1, is generally comprised of a stand, a lamp holder which holds a lamp bulb a flexible neck mounted on the lamp stand to hold the lamp holder, and an electric wire having one end inserted through the flexible neck and connected to the lamp holder and an opposite end extending out of the lamp stand and terminating in an electric plug for connection to an AC power supply outlet. This structure of desk lamp must be used indoors or in a place where city power supply is available. Therefore, this structure of desk lamp is not practical for use with a portable computer for example a notebook computer. Because there is no rigid means to support the connection between the lamp stand and the flexible neck, the lamp stand may become unstable when the flexible neck is deformed to move the lamp holder to the desired position. Sometimes, the connecting area between the lamp stand and the flexible neck may break when the flexible neck is bent to the desired shape.

SUMMARY OF THE INVENTION

The present invention has been accomplished to provide a lighting device which eliminates the aforesaid drawbacks.

According to one aspect of the present invention, the lighting device comprises an elongated, hollow, flexible neck, a plug fastened to the flexible neck at one end for connection to the computer, and a lamp assembly fastened to the flexible neck at an opposite end and connected to the plug by an electric wire, the flexible neck having a flexible metal wire axially mounted on the inside so that the flexible neck can be bent into the desired shape to move the lamp assembly to the desired position, the flexible neck being connected to the plug by a resin block, the resin block being molded on the flexible metal wire to support the flexible neck and the lamp assembly.

According to another aspect of the present invention, the plug which has one end embedded in the resin block, has a plurality of metal contact pins on the other end for connection to an electric socket of the computer for permitting the electric power supply of the computer to be transmitted to the lamp assembly.

According to still another aspect of the present invention, the flexible metal wire has one end terminating in a hook embedded in the resin block, such that when the flexible neck is bent, the flexible metal wire will not easily be pulled out of the resin block with the help of the hook.

According to still another aspect of the present invention, a jacket is fastened to the plug and covered on the resin block to hold the plug and the resin block together so that the electric wire is fixedly maintained connected to the plug.

DETAILED DESCRIPTION OF THE PREFERRED EMBODIMENT

Figure 1:
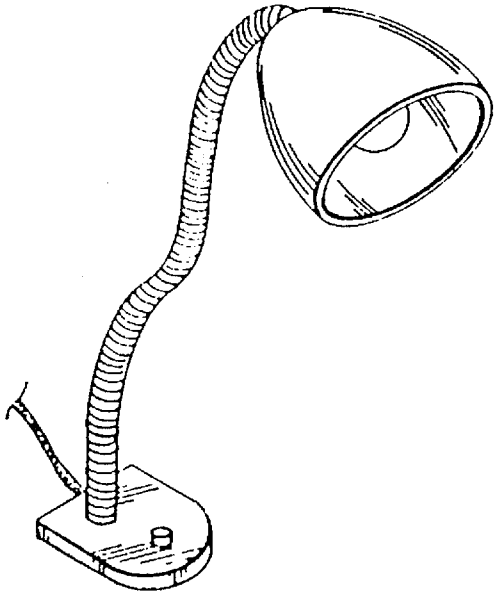
FIG. 1 PRIOR ART
FIG. 1 shows a regular desk lamp.
Figure 2:
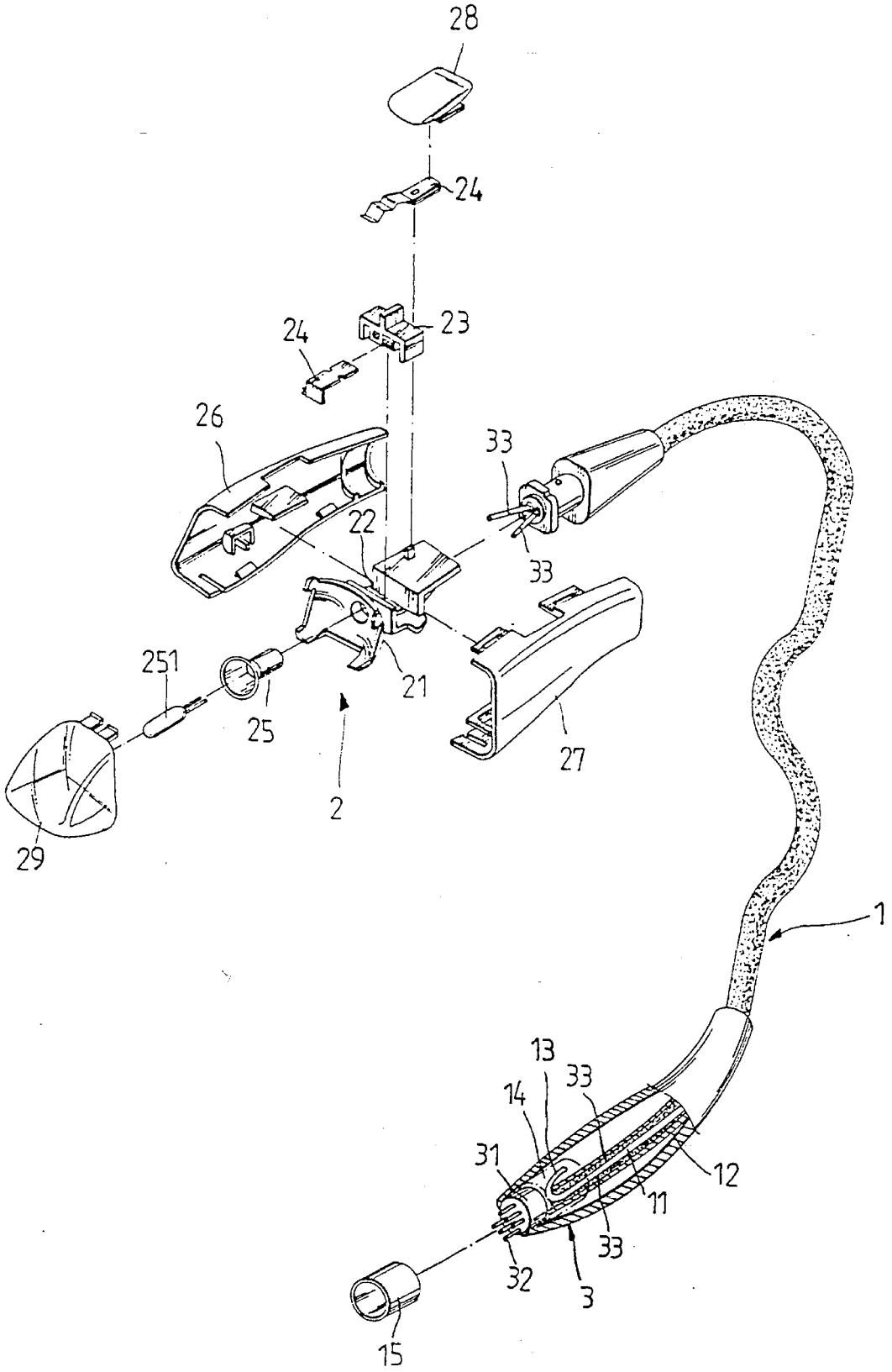
FIG. 2 is an exploded view of a lighting device according to the present invention.

Referring to FIG. 2 a lighting device for use with computers in accordance with the present invention is generally comprised of an elongated, hollow, flexible neck 1, a lamp assembly 2 at one end of the flexible neck 1, and a plug 3 at an opposite end of the flexible neck. The plug 3 comprises a casing 31, a plurality of contact pins 32 mounted in the casing 3. An electric wire 33 is inserted through the flexible neck 1 and connected between the contact pins 32 of the plug 3 and the two opposite terminals of the lamp assembly 2. A flexible metal wire 11 is inserted through the flexible neck 1 and covered within a plastic covering 12 inside the flexible support 1. The flexible metal wire 11 has one end terminating in a hook 13 embedded in a resin block 14. The resin block 14 is molded on the hook 13 of the flexible metal wire 11, and a part of the electric wire 33. A jacket 15 is fastened to the plug 3 and the resin block 14 to hold the casing 31 of the plug 3 and the resin block 14 together.

Figure 3:
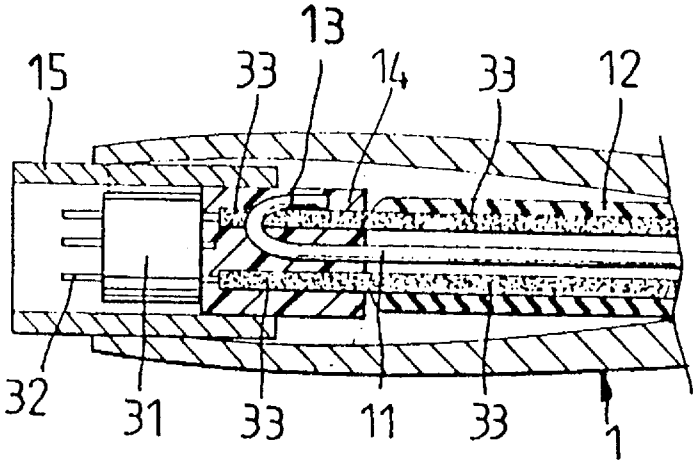
FIG. 3 is a sectional view of a part of the lighting device shown in FIG. 2, showing the hook of the flexible metal wire and one end of the electric wire embedded in the resin block.

Referring to FIG. 3 and FIG. 2 again, the lamp assembly 2 comprises a holder base 21 having a switch mounting groove 22, two metal contact plates 24 mounted in the switch mounting groove 22 and respectively connected to the electric wire 33, a lamp socket 25 fastened the holder base 21 to hold a lamp bulb 251, two cover shells 26, 27 fastened together and covered on the holder base 21 a switch 23 mounted in the switch mounting groove 22 within the cover shells 26, 27 and moved to electrically connect the metal contact plates 24, a button 28 mounted on the cover shells 26, 27 and con, rolled to switch on/off the switch 23, and a lampshade 29 fastened to the cover shells 26, 27 and covered over the lamp bulb 251.

Figure 4:
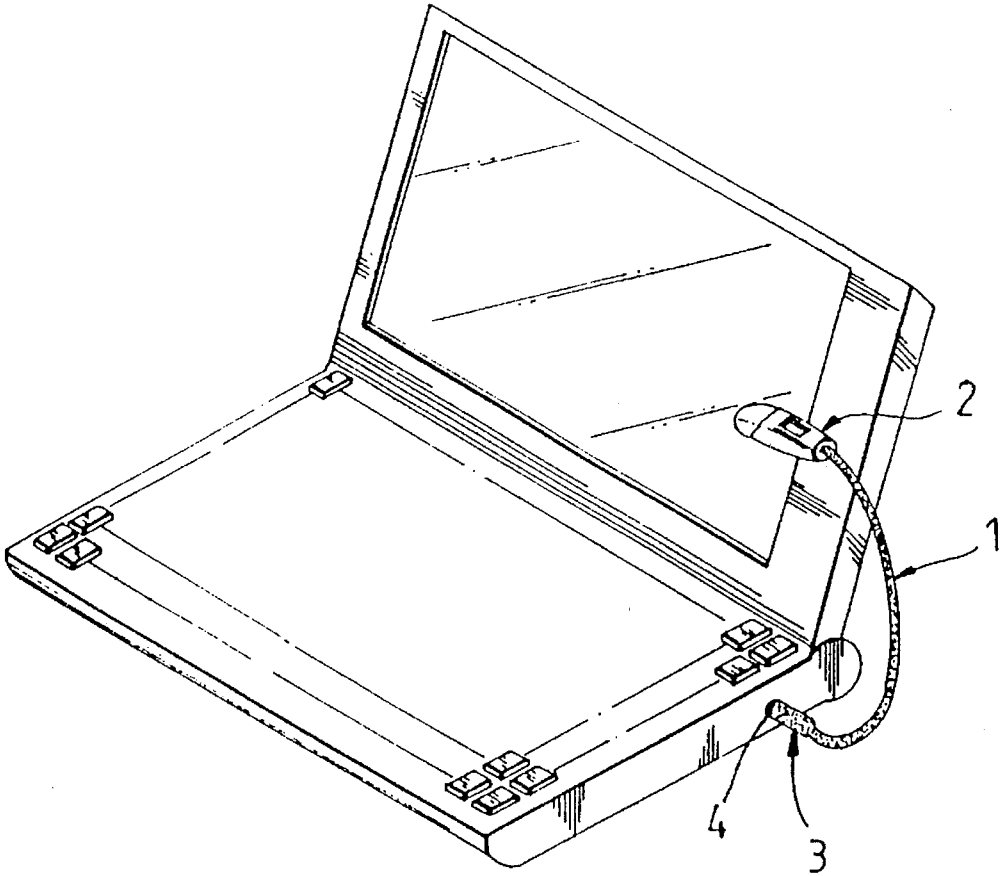
FIG. 4 is an applied view of the present invention, showing the lighting device installed in a notebook computer.

Referring to FIGS. 2 and 3 again, the resin block 14 can be made from polyethylene or polyvinyl chloride resin. Before setting, the polyethylene or polyvinyl chloride resin is covered on the flexible metal wire 11 and the electric wire 33. After setting, the resin block 14 is formed with the flexible metal Referring to FIG. 4 and FIG. 3 again, when the plug 3 is fastened to the electric socket 4 on the computer, which is used by the keyboard or interface card of the computer, the flexible neck 1 can be bent into the desired shape to turn the lamp assembly 2 to the desired direction and angle. By means of operating the button 28, electric power supply is transmitted from the power supply unit of the mainframe of the computer through the electric wire 33 to the lamp bulb 251 of the lamp socket 25, thereby causing the lamp bulb 251 to illuminate.

As indicated, because the flexible metal wire 11 and plastic covering 12 are partially embedded in the resin block 14, which is fixedly secured to the casing 31 of the plug 3 by the jacket 15, the resin block 14 can stably stand the force exerting by the user when changing the shape of the flexible neck 1 and turning the lamp assembly 2 to the desired position. Therefore, the connecting area between the flexible neck 1 and the plug 3 does not vibrate during the adjustment of the position of the flexible neck 1. Because the resin block 14 is molded on the hook 13 of the flexible metal wire 11, the flexible metal wire 11 will not be moved out of the resin block 14 when it is twisted or turned to change the angular position of the lamp assembly 2. Furthermore, because the electric wire 33 has one end embedded in the resin block 14 and the resin block 14 is fixedly secured to the casing 31 of the plug 3 by the jacket 15, the electric wire 33 will not be disconnected from the plug 3 when the flexible neck 1 is twisted or bent to the desired direction.

While only one embodiment of the present invention has been shown and described, it will be understood that various modifications and changes could be made without departing from the spirit and scope of the invention disclosed.

What the invention claimed is:

1. A lighting device for use with a computer, comprising:

an elongated, hollow, flexible neck having a first end and a second end, a flexible metal wire axially mounted on the inside and having a hook at one end disposed in the first end of said flexible neck;

a plug fastened to the first end of said flexible neck and fixedly connected with a resin block molded on the hook of said flexible metal wire; and a lamp assembly mounted on the second end of said flexible neck and connected to said plug by an electric wire.

2. The lighting device of claim 1 wherein said plug is mounted With a jacket fastened to said resin block; said electric wire has one end embedded in said resin block and connected to said plug.

3. The lifting device of claim 1 wherein said resin block is made from polyethylene resin.

4. The lighting device of claim 1 wherein said resin block is made from polyvinyl chloride resin.

5. The lighting device of claim 1 wherein said lamp assembly comprises a holder base having a switch mounting groove, two metal contact plates mounted in said switch mounting groove and connected to said electric wire, a lamp bulb, a lamp socket fastened to said holder base to hold said lamp bulb, two cover shells fastened together and covered on said holder base, a switch mounted in said switch mounting groove within said cover Shells and moved to electrically connect said metal contact plates, a button mounted on said cover shells and controlled to switch on/off said switch, and a lampshade fastened to said cover shells and covered over said lamp bulb.

* * * * *